US006086419A

United States Patent [19]

Marpoe, Jr.

[11] Patent Number: 6,086,419

[45] Date of Patent: Jul. 11, 2000

[54] ELECTRICAL CONNECTOR ASSEMBLY

[75] Inventor: Gary Ray Marpoe, Jr., Kernersville, N.C.

[73] Assignee: The Whitaker Corporation, Wilmington, Del.

[21] Appl. No.: 09/014,549

[22] Filed: Jan. 28, 1998

[51] Int. Cl.[7] ..... H01R 13/40

[52] U.S. Cl. ..... 439/595; 439/680

[58] Field of Search ..... 439/595, 680, 439/851

[56] References Cited

U.S. PATENT DOCUMENTS

| | | | |
|---|---|---|---|
| 4,358,179 | 11/1982 | Bourdon et al. | 439/595 |
| 4,387,944 | 6/1983 | Frear | 439/595 |
| 4,636,020 | 1/1987 | Marmillion | 439/595 |
| 4,985,004 | 1/1991 | Zinn | 439/851 |
| 5,775,960 | 7/1998 | Saito et al. | 439/851 |

*Primary Examiner*—Renee Luebke
*Assistant Examiner*—T. C. Patel

[57] ABSTRACT

An electrical plug connector is matable with a pin header and includes a molded plug housing with multiple contact apertures extending between a mating face and a rear face. Angularly spaced ribs extend into the contact receiving aperture to support each contact. Each rib is opposed to molded pawls that are deflectable when a contact is inserted from the rear of the housing. The ribs and the pawls are located at different angularly spaced intervals so that they do not overlap and so that the one piece housing can be molded in a straight pull manner. An annular retaining section on each contact is held between the pawls and the ribs when each contact is fully inserted into a corresponding aperture.

20 Claims, 4 Drawing Sheets

ELECTRICAL CONNECTOR ASSEMBLY

BACKGROUND OF THE INVENTION

1. Field of the Invention

This invention is related to electrical connectors and is more specifically related to electrical connectors with molded housings.

2. Description of the Prior Art

Many electrical connectors employ molded housings into which contact terminals attached to wires are inserted through the rear of the housing. However, most of these connectors employ either a separate latching member to secure the contacts in the housing or include relatively large latches that are molded as part of the connector housing. Most of these connectors employ contacts with rectangular cross sections. Many electrical connectors employ socket contacts having a circular cross section.

SUMMARY OF THE INVENTION

This invention employs a one-piece molded housing that can be molded as a straight pull without the use of side pulls. The connector uses cylindrical contacts that have a generally circular cross section.

This electrical connector comprises a housing formed from a dielectric material. The housing includes at least one contact aperture extending through the housing between opposite first and second ends. The housing includes a plurality of ribs spaced at angular intervals and extending into each contact aperture. The ribs extend inwardly adjacent a first end of the housing. The housing also includes a plurality of deflectable pawls more closely adjacent to the second end of the housing, which extend radially into each contact receiving aperture. The deflectable pawls also are positioned at angularly spaced intervals and are spaced angularly between the ribs. The electrical connector also includes a contact insertable into the contact aperture through the second housing end. The pawls are deflectable to permit insertion of the contacts so that the pawls and the ribs engage a fully inserted contact to retain the fully inserted contact in a corresponding contact aperture.

DETAILED DESCRIPTION OF THE INVENTION

Figure 1:
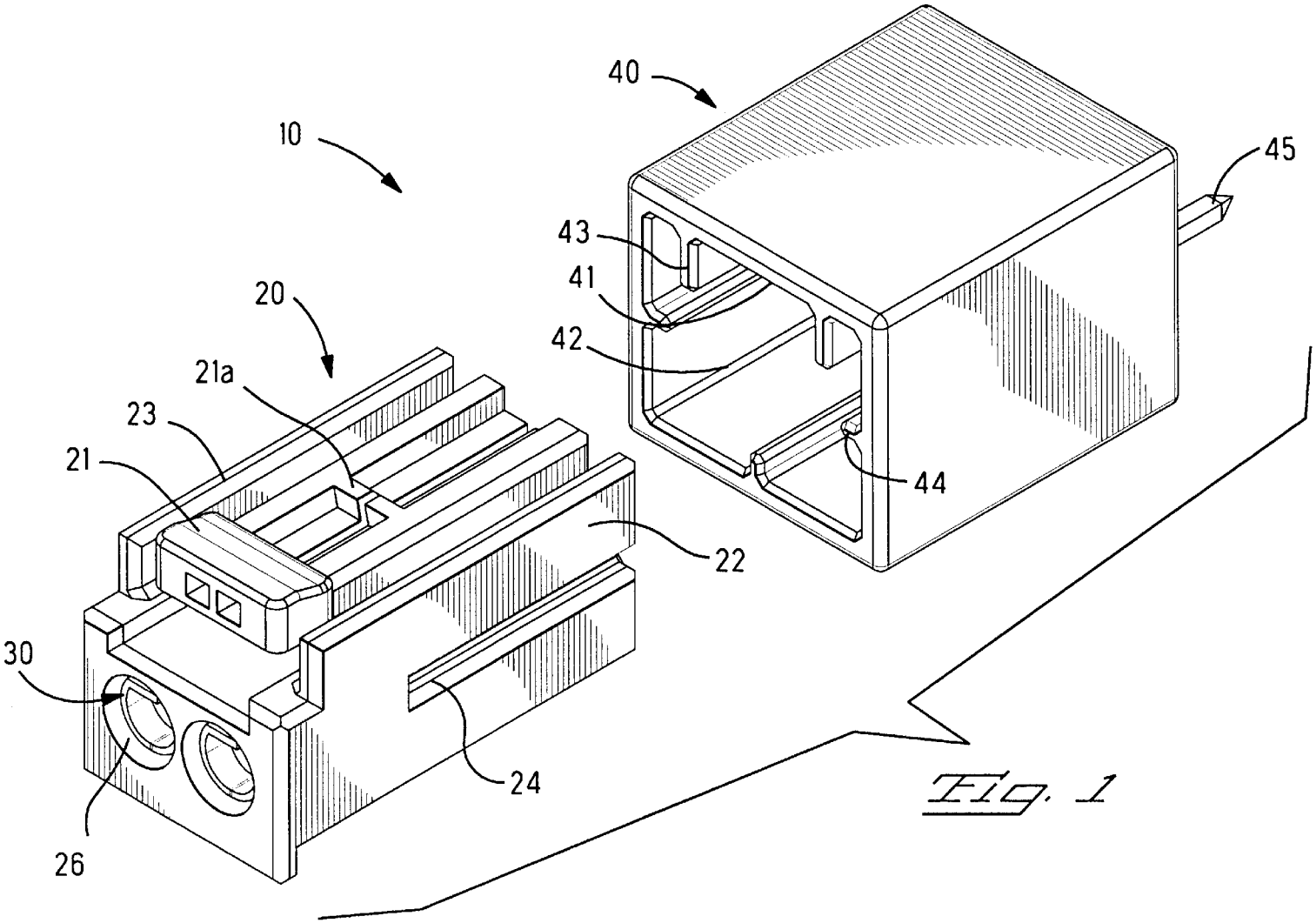
FIG. 1 is an isometric view of an electrical connector assembly according to the present invention.
Figure 2:
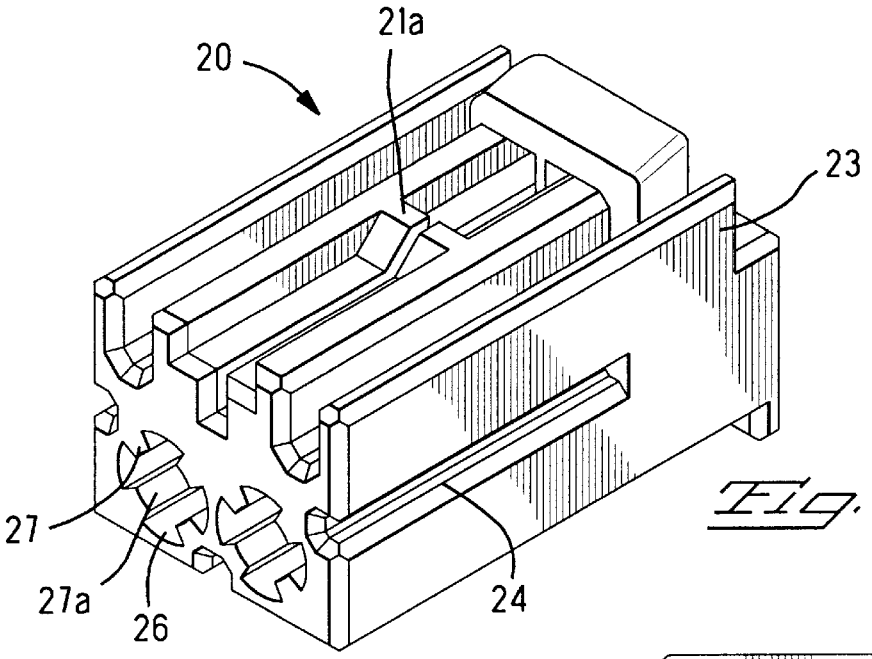
FIG. 2 is a front-side isometric view of the plug housing of FIG. 1.

Referring to FIG. 1, an electrical connector assembly 10 according to the present invention is shown. Electrical connector assembly 10, which is preferably used in wire-to-wire electrical interconnection applications, includes a plug housing 20 and a matable header 40, each being formed or molded from a suitable dielectric material.

Referring to FIGS. 1–5, plug housing 20 includes a deflectable latch 21 with latching members 21*a* formed thereon. Latch 21 is located between walls 23, which walls are adjacent to respective side-walls 22 of plug housing 20. Walls 23 are operative to protect latch 21 from snagging on wires during, for example, an assembly process of electrical connector 10 to a wiring harness (not shown). Side walls 22, and a bottom wall 25, each comprise a respective groove-like alignment recess 24 formed therein.

Figure 3:
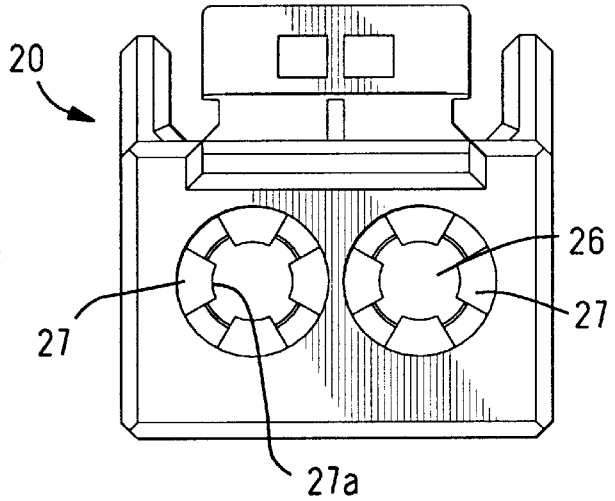
FIG. 3 is an elevational view of the wire exit face of the plug housing of FIG. 2.
Figure 4:
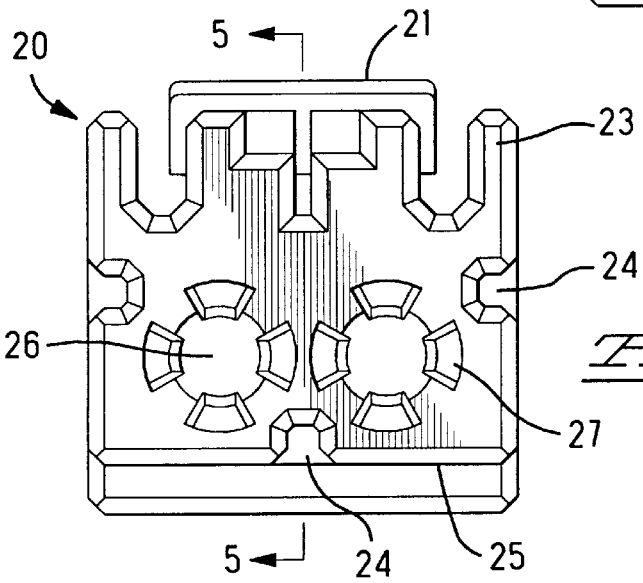
FIG. 4 is an elevational view of the mating face of the plug housing of FIG. 2.
Figure 5:
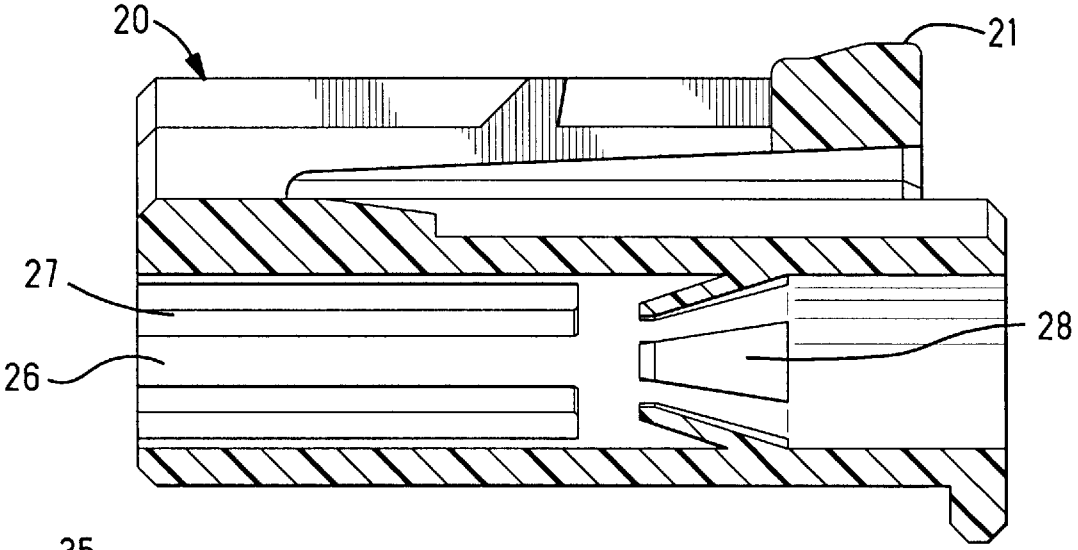
FIG. 5 is a cross sectional view of the plug housing of FIG. 4 taken along line 5—5.

As best shown in FIG. 5, contact receiving apertures 26 are formed in plug housing 20 and extend between opposite mating and rear faces or first and second ends. Each aperture 26 comprises a cylindrical shaped chamber having a plurality of axially directed contact guiding members comprising ribs 27, more closely adjacent to the mating face. Each guiding rib 27 comprises an arcuate surface 27*a* which extends axially along the guiding rib. As is best shown in FIGS. 3–4, guiding ribs 27 are circumferentially spaced at generally 90 degree intervals about a longitudinal axis of aperture 26, with arcuate surfaces 27*a* cupped toward the longitudinal axis of aperture 26. Apertures 26 also include robust, deflectable pawls 28 extending from a wall thereof toward a center of the aperture and forming an integral part of the molded plug housing. Each pawl comprises a proximal end attached to the aperture wall and a distal end tip for engagement with an electrical contact, as will be described below. The transverse cross sectional area of each pawl 28 varies along the length of the pawl, i.e. the cross sectional area of the pawl at the locus of the proximal end is greater than that of the distal end, such that the cross sectional area is reduced from the proximal to the distal end. The varying of the cross sectional area affects the flexure of the pawls as a contact is inserted in aperture 26, whereby maximum contact retention is established while minimizing contact insertion forces into plug housing 20.

Figure 6:
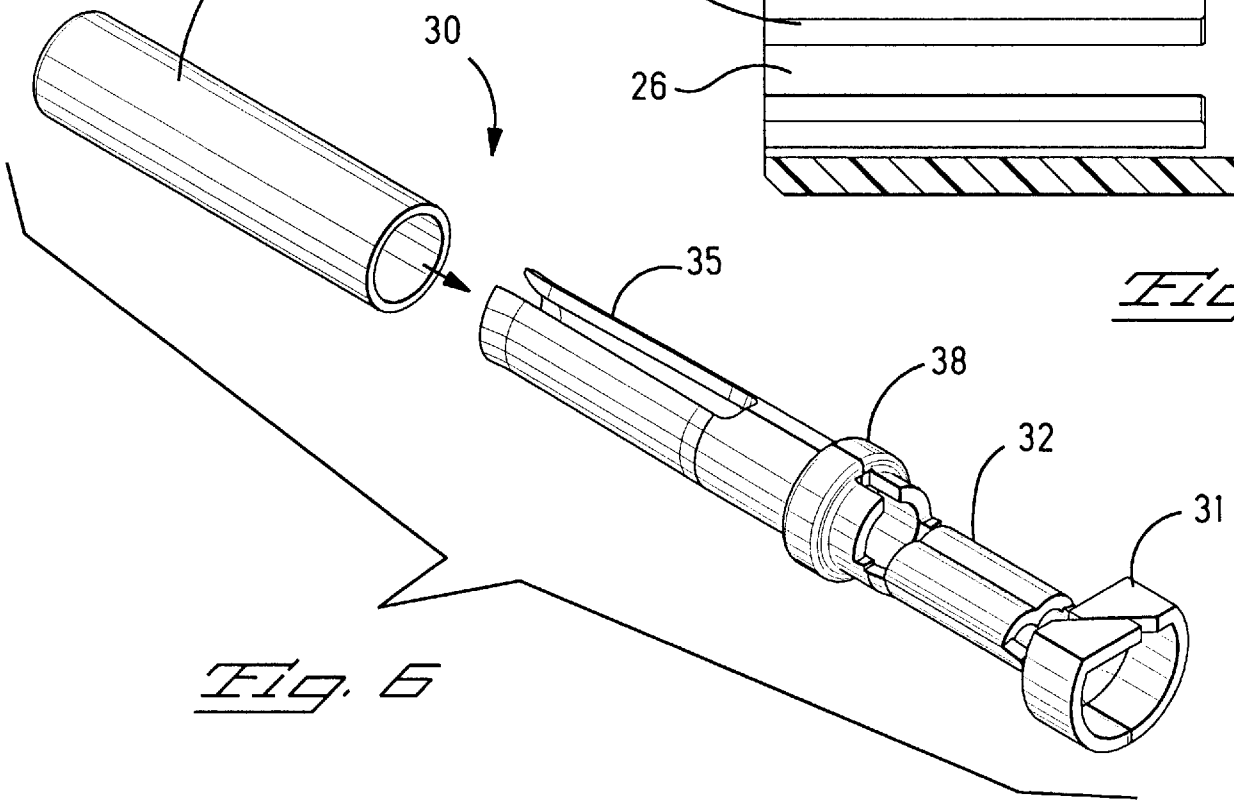
FIG. 6 is an isometric view of an electrical contact assembly for use with the electrical connector assembly of the present invention.

Electrical socket contact assembly 30, which is sized to be received in a contact receiving aperture 26, is formed of a suitable conductive material. As best shown in FIG. 6, socket contact 30 includes an insulation crimp section 31, a wire crimp section 32, and a resilient pin receiving section 35. A sleeve 37 will be assembled to pin receiving section 35. Socket contact assembly 30 further includes an annular retaining section 38 formed between wire crimp section 32 and pin receiving section 35.

Header 40 includes a plug housing receiving cavity 42 with a latching member 41 (best shown in FIG. 7), walls 43, and alignment ribs 44. Electrical contact pins 45 extend through a back wall of header 40 into cavity 42 for electrical engagement with respective electrical contacts 30 in plug housing 20. Preferably, pins 45 are of the wire-bondable type, and are therefore suitable for wire-bonding to wire leads (not shown).

Figure 7:
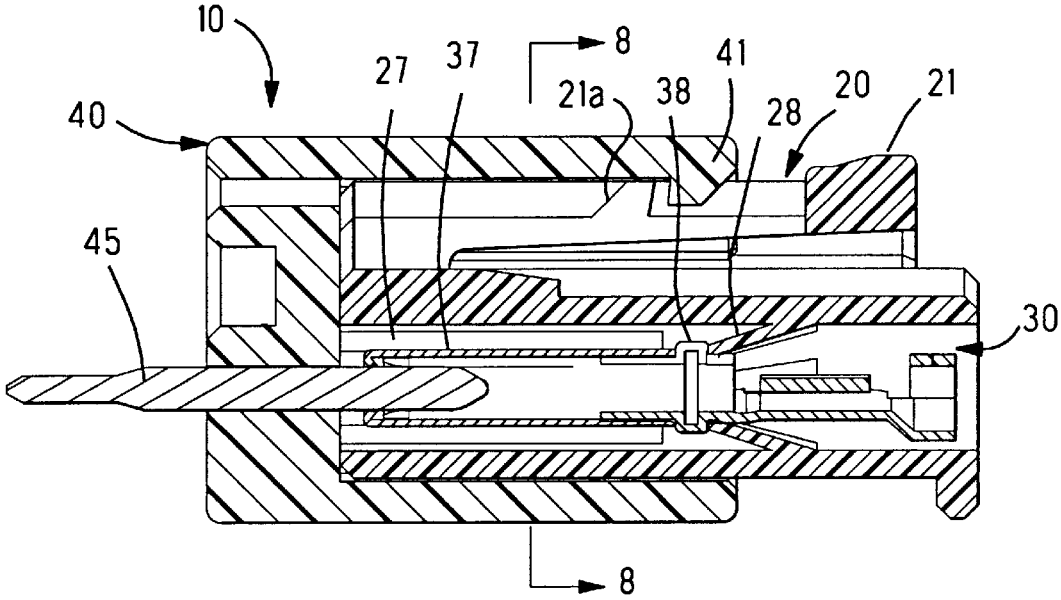
FIG. 7 is a cross sectional view of the electrical connector assembly according to the present invention when in a fully assembled state.
Figure 8:
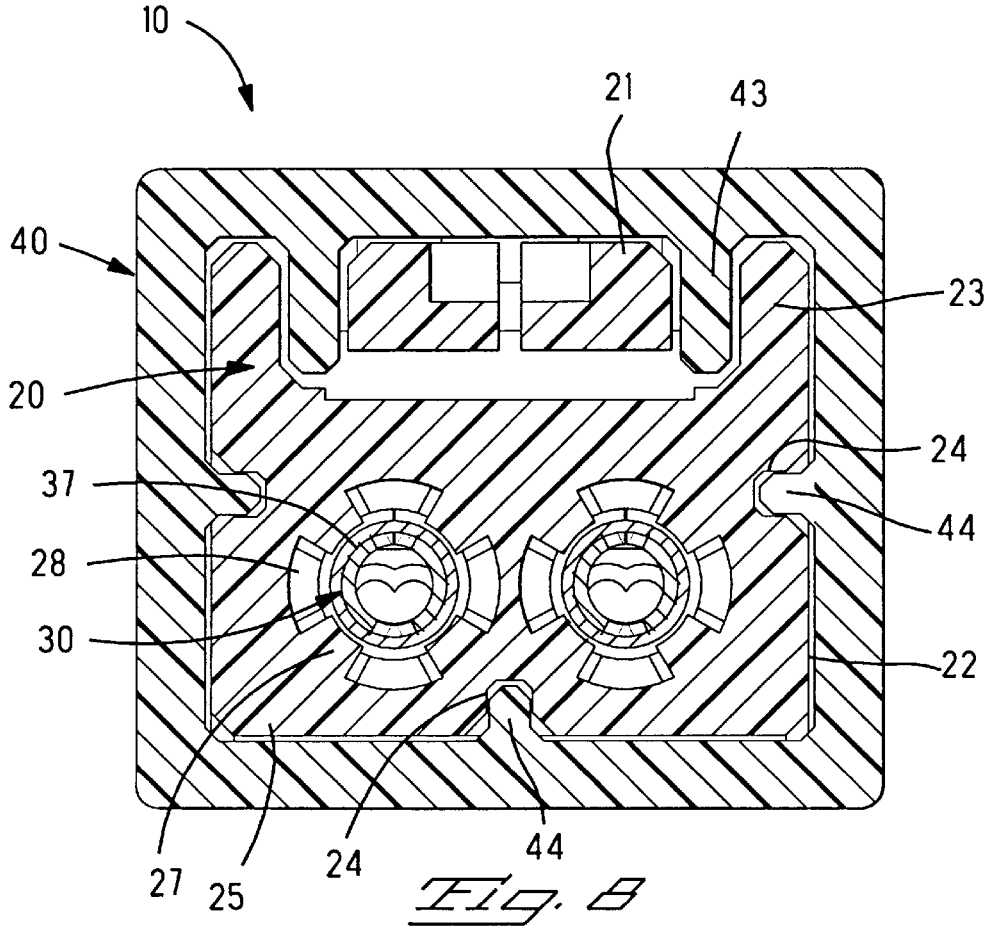
FIG. 8 shows a cross sectional view of the electrical connector of FIG. 7 taken along line 8—8.

Assembly of electrical connector assembly 10 will now be described. First, socket contacts 30 are inserted into respective contact receiving apertures 26 so that sleeves 37 will pass pawls 28. As this occurs, sleeve 37 will be centered and guided by contact guiding ribs 27 in aperture 26. The outer surfaces of sleeves 37 will slide on arcuate surfaces 27*a*, and the spacing of guiding ribs 27 assures a precise, centered positioning of contact assemblies 30 in apertures 26 of plug housing 20 (FIG. 8). Also, retaining section 38 of contact assembly 30 will deflect the distal ends of pawls 28 as it moves past them. When retaining section 38 is past pawls 28, the pawls will resile into a latching position with respect to retaining section 38, and retaining section 38 will thereby be constrained against axial movement by pawls 28 when contact assembly 30 is fully inserted, as shown in FIG. 7. Contact assembly 30 is thus secured in plug housing 20 because retaining section 38 is axially trapped between pawls 28 and guiding ribs 27, the pawls and guiding ribs each defining an internal diameter of aperture 26 which is less than the outer diameter of retaining section 38.

Next, plug housing 20 is aligned with header 40 so that as plug housing 20 is inserted into cavity 42, polarization of plug housing 20 with respect to header 40 occurs as walls 43 slide into respective locations between alignment walls 23 and latch 21, and alignment ribs 44 register with alignment recesses 24 (FIG. 8). Latch 21 is deflected as latching members 21*a* slidingly engage latching member 41 of header 40. When plug housing 20 has been fully inserted into cavity 42, latch 21 will snap into a latched position therein with an audible click sound so that an operator will be alerted that full mating has taken place. A predetermined, minimum sliding clearance between ribs 44 and recesses 24, as is best shown in FIG. 8, controls the relative positions of plug housing 20 and header 40 during mating so that precise alignment is achieved between plug housing 20 and header 40. Because precise alignment occurs between header 40 and plug housing 20, and between plug housing 20 and contact assemblies 30, precise socket-to-pin alignment is achieved between pins 45 of header 40 and socket contact assemblies 30 in plug housing 20.

In view of the foregoing, several advantages are obtained by the present invention. The outer surfaces of sleeves 37 will slide on arcuate surfaces 27*a*, and the spacing of guiding ribs 27 assures a precise, centered positioning of contact assemblies 30 in apertures 26. Additionally, socket contact assemblies 30 are secured in plug housing 20 because retaining section 38 is axially trapped between pawls 28 and guiding ribs 27, which provides a high amount of retention force for plug housing 30. Moreover, because precise alignment occurs between header 40 and plug housing 20, and between plug housing 20 and contact assemblies 30, precise socket-to-pin alignment is achieved between pins 45 of header 40 and contact assemblies 30 in plug housing 20. The plug housing can also be molded as a one piece member, and the ribs and pawls do not overlap so that the plug housing can be molded in a straight pull manner in the direction of the axis of the contact apertures. No expensive side pulls are necessary.

What is claimed is:

1. An electrical connector matable with a mating connector comprising a one-piece molded housing formed from a dielectric material and matable with a mating electrical connector housing and including at least one contact aperture extending through the molded housing between opposite first and second ends, the molded housing including a plurality of ribs spaced at angular intervals and extending into each contact aperture, the ribs extending inwardly adjacent a first end of the molded housing, the molded housing also including a plurality of deflectable pawls more closely adjacent to the second end of the molded housing and extending radially into each contact receiving aperture, the deflectable pawls also being positioned at angularly spaced intervals and being spaced angularly between the ribs, the electrical connector also including a contact insertable into the contact aperture through the second housing end, the pawls being deflectable to permit insertion of the contacts, the pawls and the ribs engaging a fully inserted contact to retain a fully inserted contact in a corresponding contact aperture, wherein the contact comprises a cylindrical socket including contact means for engaging a pin when the electrical connector is mated with the mating connector, and the ribs comprise contact guiding members conforming to the exterior of the female contact to align the socket centrally within the corresponding aperture so that pin is smoothly received within the socket when the electrical connector is mated with the mating connector.

2. The electrical connector of claim 1 wherein inner ends of the ribs are axially spaced from distal ends of the pawls.

3. The electrical connector of claim 2 wherein the contact includes an annular retaining section, the outer diameter of the annular retaining section being sufficient to deflect distal ends of the pawls during insertion of the contact into a corresponding contact aperture.

4. The electrical connector of claim 3 wherein the annular retaining section is insertable axially between the ribs and the pawls when the contact is fully inserted so that the ribs and pawls prevent axial movement of the contact in two opposite directions.

5. The electrical connector of claim 4 wherein the annular retaining section has the shape of a circular cylinder.

6. The electrical connector of claim 3 wherein the outer diameter of the annular retaining section on the contact is greater than the diameter of a cylinder defined by inner ends of the ribs.

7. The electrical connector of claim 1 wherein the pawls are inclined from proximal ends more closely adjacent to the second end to distal ends more closely adjacent to the first end.

8. The electrical connector of claim 1 wherein contact apertures have a generally circular cylindrical contour.

9. The electrical connector of claim 1 wherein the ribs support the sides of corresponding contacts.

10. The electrical connector of claim 1 wherein inner axially extending surfaces of the ribs are cupped to conform to a cylindrical contour.

11. An electrical connector matable with a mating connector comprising:

a one-piece molded plug housing matable with a mating connector housing having a plurality of contact apertures extending between a mating face and a rear face;

the molded plug housing including a plurality of molded ribs protruding into each contact aperture, the ribs extending axially along at least a portion of each contact aperture relatively more closely to the mating face;

the molded plug housing including at least one molded deflectable pawl protruding into each contact aperture, each deflectable pawl being located more closely to the rear face than ribs protruding into the same contact aperture;

a plurality of contacts, each contact being insertable into a corresponding contact aperture through the rear face of the plug housing into engagement with the ribs and at least one pawl in the same contact aperture;

the ribs and the pawls in the same contact aperture being located at different angular positions in the corresponding contact aperture so as not to angularly overlap;

wherein the contact comprises a cylindrical socket including contact means for engaging a pin when the electrical connector is mated with a mating connector, and the ribs comprise contact guiding members conforming to the exterior of the female contact to align the socket centrally within the corresponding aperture so that pin is smoothly received within the socket when the electrical connector is mated with the mating connector.

12. The electrical connector of claim 11 wherein the pawls and the ribs are located at different angular positions so that the plug housing can be molded by straight pull tooling.

13. The electrical connector of claim 11 wherein the contact apertures are circular in cross section with the ribs and pawls extending radially into the circular contact apertures.

14. The electrical connector of claim 11 wherein a plurality of molded pawls extend into each contact aperture.

15. The electrical connector of claim 11 wherein the cross sectional area of each pawl decreases from a proximal end to a distal end extending further radially into the contact aperture.

16. The electrical connector of claim 11 wherein the ribs are axially spaced from the pawls in the same contact receiving aperture.

17. The electrical connector of claim 11 wherein each contact includes a cylindrical sleeve on a pin receiving end.

18. The electrical connector of claim 11 wherein each contact includes a protruding retaining section on the exterior of the contact dimensioned to be opposed to the ribs and at least one pawl in the contact aperture when the contact is inserted into the contact aperture.

19. The electrical connector of claim 18 wherein the retaining section comprises an annular section.

20. The electrical connector of claim 11 wherein the plug housing is molded as a one piece member with the ribs and pawls forming molded extensions of the plug housing.

* * * * *